US009175913B2

(12) United States Patent
Cupps et al.

(10) Patent No.: US 9,175,913 B2
(45) Date of Patent: Nov. 3, 2015

(54) LATCHLESS CHARGING HANDLE

(71) Applicants: James Wesley Cupps, Silverton, OR (US); David Vernon Hill, Salem, OR (US)

(72) Inventors: James Wesley Cupps, Silverton, OR (US); David Vernon Hill, Salem, OR (US)

( * ) Notice: Subject to any disclaimer, the term of this patent is extended or adjusted under 35 U.S.C. 154(b) by 64 days.

(21) Appl. No.: 14/168,379

(22) Filed: Jan. 30, 2014

(65) Prior Publication Data

US 2014/0318356 A1 Oct. 30, 2014

Related U.S. Application Data

(60) Provisional application No. 61/759,246, filed on Jan. 31, 2013.

(51) Int. Cl.
*F41F 5/00* (2006.01)
*F41A 3/72* (2006.01)

(52) U.S. Cl.
CPC ..... *F41A 3/72* (2013.01)

(58) Field of Classification Search
USPC ..... 89/1.4, 191.01, 192; 42/2
See application file for complete search history.

(56) References Cited

U.S. PATENT DOCUMENTS

| | | | | |
|---|---|---|---|---|
| 6,311,603 | B1 | 11/2001 | Dunlap | |
| 7,240,600 | B1 * | 7/2007 | Bordson | 89/1.4 |
| 7,832,322 | B1 * | 11/2010 | Hoel | 89/1.4 |
| 2006/0162221 | A1 | 7/2006 | McLaren | |
| 2011/0214558 | A1 * | 9/2011 | Kincel | 89/1.4 |
| 2013/0192113 | A1 | 8/2013 | Melville | |
| 2014/0060293 | A1 * | 3/2014 | Gomez | 89/1.4 |

FOREIGN PATENT DOCUMENTS

| | | | |
|---|---|---|---|
| CA | 2802637 | A1 | 8/2013 |

* cited by examiner

*Primary Examiner* — J. Woodrow Eldred
(74) *Attorney, Agent, or Firm* — Stewart Myers

(57) ABSTRACT

A latchless charging handle that allows for the charging of a rifle without the need to first release a charge handle latch is provided herein. The latchless charging handle contains a detent ball assembly that engages a latch pocket on the rifle's upper receiver and acts as the charging handle's latch mechanism. When a rifle operator charges the rifle, the operator exerts a pulling force on the latchless charging handle that causes the detent ball to depress thereby freeing the charging handle from the rifle's upper receiver. When the bolt returns to battery, the detent ball assembly re-engages the latch pocket on the rifle's upper receiver and secures the charging handle.

20 Claims, 5 Drawing Sheets

LATCHLESS CHARGING HANDLE

CROSS-REFERENCES TO RELATED APPLICATIONS

This application claims priority to U.S. Provisional Patent Application Ser. No. 61/759,246 filed on Feb. 31, 2013 entitled "Ambidextrous charging handle for AR style rifles", the disclosure of which is hereby incorporated by reference.

BACKGROUND OF THE INVENTION

1. Field of the Invention

The present invention relates to charging handles for rifles, and more specifically, to an ambidextrous charging handle for use with an AR-15® type rifle that does not use a latch to secure the charging handle to the rifle.

2. Description of the Related Art

Modern repeating firearms utilize a bolt to engage and fire ammunition. The ignition of the ammunition not only fires the bullet, but also causes the bolt to cycle. Most firearms then utilize a system to return the bolt to a firing position, battery, which is usually a mechanical return spring. Sometimes, however, the weapon may experience a minor malfunction, either in the feeding of ammunition or in the return system or some other malfunction, which causes the bolt to jam in a position that does not allow firing. To this end, early charging handles, which were essentially a part of the bolt carrier group itself and cycled with the bolt, were used to return the bolt to firing position. These reciprocating charging handles worked in both directions to retract the bolt and to act as a forward assist, closing the bolt with additional pressure beyond that of the return spring. However, these externally reciprocating parts could cause malfunctions or user injury if accidentally contacted during firing. Hence, non-reciprocating designs, in which the charging handle is separate and will selectively engage the bolt carrier, have become more popular.

Common charging handles are configured as an elongated rod with a rearward handle disposed in a perpendicular orientation with respect to the rod (commonly described as a "T" shape); the handle is grasped and pulled backward, which moves the rod (and the bolt carrier to which it is engaged) in a rearward direction. It is also known within the existing art to provide charging handles with latching mechanisms, commonly called tactical latches, to prevent unintended rearward movement of the charging handle during operation or inspection of the weapon. The forward end of the latch engages the side of the receiver housing, thereby holding the charging handle in position.

Generally, the latch provides a pivoting mechanism held in tension by a spring. The receiver end of the pivoting mechanism features a ramped forward edge which enables the passage of the tensioned latch onto the notched portion of the receiver. Once within the receiver notch, a flattened rear edge of the pivot latch prevents the latch from sliding rearwards, effectively locking the charging handle into the receiver. Once the distal end of the pivoting latch is depressed, the charging handle may be released.

Automatic and semi-automatic rifles, called carbines, are gaining in popularity as a firearm of choice for law enforcement agencies, including police departments of larger metropolitan areas. Agencies have begun a shift from issuing shotguns with multiple projectile rounds to M-16® military and civilian variants able to deliver single projectile rounds with improved accuracy and extended distance. Training officers to properly operate a carbine takes many hours, and the officer has to practice the techniques for handling this new weapon through thousands of repetitions to render the handling techniques habitual and instinctive, which is crucial to enable the officer to respond correctly under stressful situations.

While carbines have certain recognized advantages in different situations, problems have been identified with commonly available charging handles. For example, most charging handles have been designed for right-handed operators; supporting the rifle with the left hand, the operator uses two fingers of the right hand (one on either side of the charging handle rod) to pull backwards on the charging handle in a straight line parallel to the bolt carrier of the rifle, disengaging the latch, and requiring the operator to remove the right hand from the weapon trigger.

Ambidextrous charging handles are known within the art. To ease torsion of the charging handle assembly, manufacturers have taken to adding material to both sides of the charging handle in order for both index and middle fingers to place even linear forces upon the charging bar.

In both single-sided and ambidextrous charging handles, the charging-handle latch must be acted upon in order to release the bolt. This can often be challenging if the firearm has optical devices overriding the charging handle, or limited access to the handle is presented. This task can be even more challenging if the user is wearing gloves, or is situationally compromised such as firing the rifle from a position that prevents access to both sides of the rifle, as when using a tree as a brace for the rifle.

It could be said there exists a need for a latchless ambidextrous charging handle which remains in the forward position unimpeded until use is required. The present invention meets this need by providing the user with a charging handle which sees the standard pivoting latch replaced by a detent ball system, thus allowing the user to release the charging handle easier and more efficiently while still allowing for full retention of the charging handle when not in use.

BRIEF SUMMARY OF THE INVENTION

The present invention provides a latchless charging handle that allows for the charging of a rifle without the need to first release a charge handle latch. The latchless charging handle contains a detent ball assembly that engages a latch pocket on the rifle's upper receiver that acts as the charging handle's latch mechanism. When a rifle operator charges the rifle, the operator exerts a pulling force on the latchless charging handle that causes the detent ball to depress thereby freeing the charging handle from the rifle's upper receiver. When the rifle's bolt returns to battery, the detent ball assembly re-engages the latch pocket on the rifle's upper receiver and secures the charging handle.

Embodiments of the present invention are generally used to cock the hammer or striker of a rifle, but can also facilitate several other functions. The latchless charging handle can be actuated to eject a spent shell casing or an unfired cartridge from a rifle's chamber, load a cartridge from a magazine that has been inserted into the rifle or that has been manually inserted into the rifle's chamber, clear a blockage or jam, allow a rifle operator to visually inspect a rifle's chamber or verify that the chamber is empty of rounds, act as a forward assist and move the rifle's bolt into battery, or release a bolt locked to the rear if a rifle is equipped with a last-round-hold-open feature.

Embodiments of the present invention can be used ambidextrously, by either hand of a rifle operator, from either side of the rifle.

The preceding brief description is intended to merely outline some functions and advantages of the present invention.

The following disclosure will set forth other functions and advantages of the present invention along with novel features that distinguish the present invention from the prior art. It is to be understood that the following disclosure is by no means intended to limit the scope of the present invention or any of its embodiments. It is also to be understood that the accompanying illustrations are presented for descriptive purposes only and similarly are not intended to limit the scope of present invention or any of its embodiments. The following disclosure and accompanying illustrations may describe various features of novelty that characterize the invention. The invention does not reside any particular feature when taken in the singular, but in the combination of features as described herein.

Figure 1:
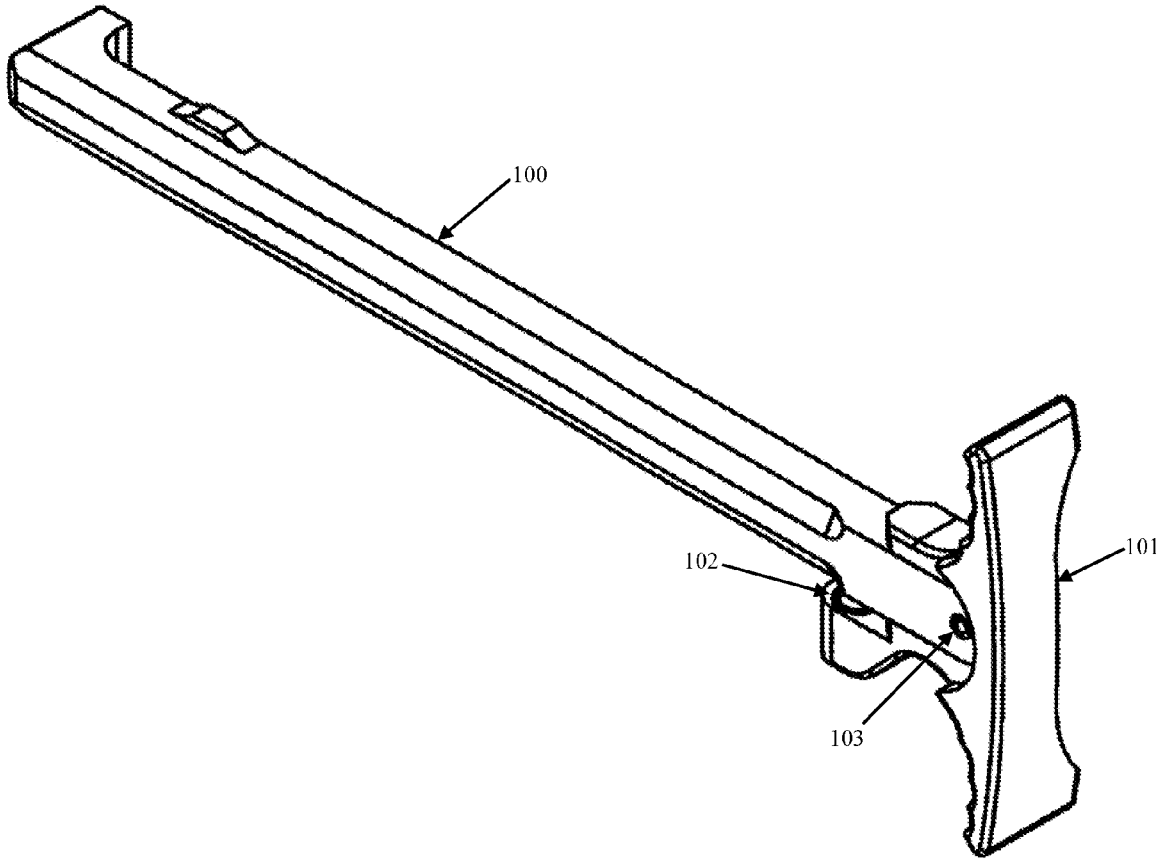
FIG. 1 is a perspective view of an exemplary latchless charging handle as according to one embodiment of the present invention.
Figure 2:
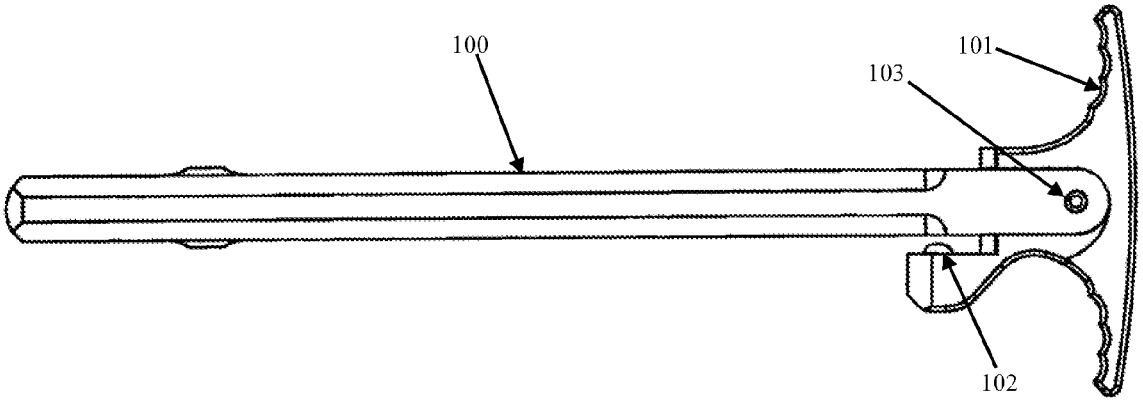
FIG. 2 is a top plan view of an exemplary latchless charging handle as according to one embodiment of the present invention.
Figure 3:
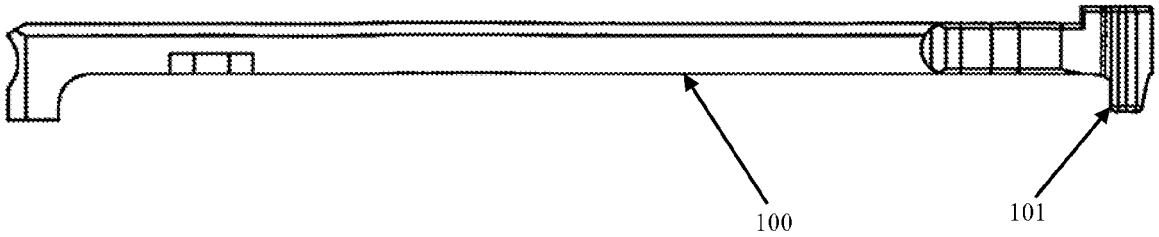
FIG. 3 is a side elevation view of an exemplary latchless charging handle as according to one embodiment of the present invention.

A further understanding of the present invention can be obtained by reference to a preferred embodiment set forth in the accompanying description. Although the illustrated embodiments are merely exemplary of apparatus for carrying out the present invention, both the organization and construction of the invention, in general, together with further objectives and advantages thereof, may be more easily understood by reference to the illustrations and the following description. The figures are not intended to limit the scope of this invention, but merely to clarify and exemplify the invention.

Certain figures contain labels, measurements, or other alphanumeric indicators. None of the aforementioned are intended to limit the scope of the invention, but are included merely to clarify and exemplify the invention.

DETAILED DESCRIPTION OF THE INVENTION

In the following detailed description, reference is made to the accompanying images that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by appended claims, appropriately interpreted, along with the full range of equivalents to which the claims are entitled.

Further, the purpose of the Abstract of the Disclosure herein is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application nor is it intended to be limiting as to the scope of the invention in any way.

The word "exemplary" is used herein to mean "serving as an example, instance, or illustration." Any embodiment described herein as "exemplary" is not necessarily to be construed as preferred or advantageous over other embodiments. Likewise, the terms "embodiment(s) of the invention", "alternative embodiment(s)", and "exemplary embodiment(s)" do not require that all embodiments of the apparatus include the discussed feature, advantage or mode of operation. The following descriptions of the preferred embodiments are merely exemplary in nature and is in no way intended to limit the invention, its application, or use.

For the purpose of clarity, all like elements will have the same numbering and designations in each of the images. The terms "latchless charging handle", "charging handle", "present invention", and "invention" may be used interchangeably. In addition to the functions, features, components, and abilities of the apparatus already discussed in this specification, the latchless charging handle may also have, but not be limited to, the following features contained within the description set forth herein.

Several preferred embodiments of the latchless charging handle are discussed in this section. However, the invention is not limited to these embodiments. A latchless charging handle, as according to the present invention, is any charging handle for a firearm that does not utilize a charge handle latch and can be used from either side of the firearm.

Embodiments of the present invention are well-suited for use with rifles designed by Eugene Stoner of the Fairchild ArmaLite Corporation, particularly the AR type of rifles and all derivations thereof including the AR-15® rifle. However, those skilled in the art may readily and easily, without undue experimentation, adapt the present invention for use with other rifle or firearm types.

Referring now to FIGS. 1-5, that will be discussed together, there are shown views of an exemplary latchless charging handle as according to one embodiment of the present invention. The latchless charging handle comprises a bolt interface (100) that interfaces with a bolt or a bolt assembly of a firearm, such as a rifle. The bolt interface (100) is used to retract the bolt of a rifle so that the bolt locks in a rearward position making the rifle ready to accept a cartridge for firing. Once the bolt interface (100) has moved the bolt to a rearward position, the releasing of the bolt will cause the cartridge to load into the rifle's firing chamber. It should be noted that the bolt interface (100) can also be used to eject a spent shell casing or unfired cartridge from the rifle's chamber, clear a blockage; jam; misfire; or obstruction, allow the rifle's operator to inspect the chamber, act as a forward assist to move the bolt into battery, or release a bolt locked to the rear if a rifle is equipped with a last-round-hold-open feature.

The bolt interface (100) is a generally elongated member with an upper surface that is oriented toward the upper side of a firearm when in use. The upper side of the firearm being the surface where the sights or a mounted scope system of a rifle is located. The bolt interface (100) also has a lower surface that is oriented toward the lower portion of the firearm. The lower portion of the rifle being the area where the trigger or magazine are located. The forward part of the bolt interface (100) is the area that interfaces with the bolt or bolt assembly of the firearm. In some embodiments of the present invention, the forward part of the bolt interface (100) directly contacts the bolt or bolt assembly of a firearm. The bolt interface (100) also has a rear part that is connected, by way of a roll pin (103) to a charging bar handle (101). The rear part of the bolt interface (100) is also the part of the latchless charging handle that contains the detent ball assembly (102) that secures the latchless charging handle to the firearm.

Other components of the latchless charging handle include a charging bar handle (101) that is located at the opposite end of the latchless charging handle from the bolt interface (100) and is connected to the bolt interface (100), a detent ball assembly (102), and a roll pin (103). The charging bar handle (101) allows a user to grasp and actuate the latchless charging handle. Actuating the latchless charging handle can be done for a plurality of reasons including loading a cartridge into the chamber, clearing the chamber of obstructions or debris, or moving the bolt so the rifle's user can inspect the chamber. The charging bar handle (101) is positioned and shaped so that a user of either-hand dominance can use the present invention. Furthermore, the charging bar handle (101) allows users to actuate the latchless charging handle from either side of the rifle. The charging bar handle (101) does not interfere with a rifle-mounted scope system, if such a system is employed on the weapon.

The charging bar handle (101) has one or more handholds that extend from the latchless charging handle. The handholds are shaped so that a user can easily actuate the latchless charging handle with their fingers, or palm of their hand. The handholds are roughly concave in shape and extend outward from the centerline of the charging bar handle (101). Some embodiments of the present invention have two mirror-image handholds in a planar orientation extending out from the center of the charging bar handle, in a "T" formation.

The detent ball assembly (102) is a ball-and-spring assembly located in the bottom rear portion of the latchless charging handle. The detent ball assembly (102) is the mechanical arrangement of the present invention that holds the latchless charging handle in a fixed position relative to the rifle. The detent ball assembly (102) prevents unwanted sliding of the latchless charging handle when the charging handle is not actuated by a user.

Figure 4:
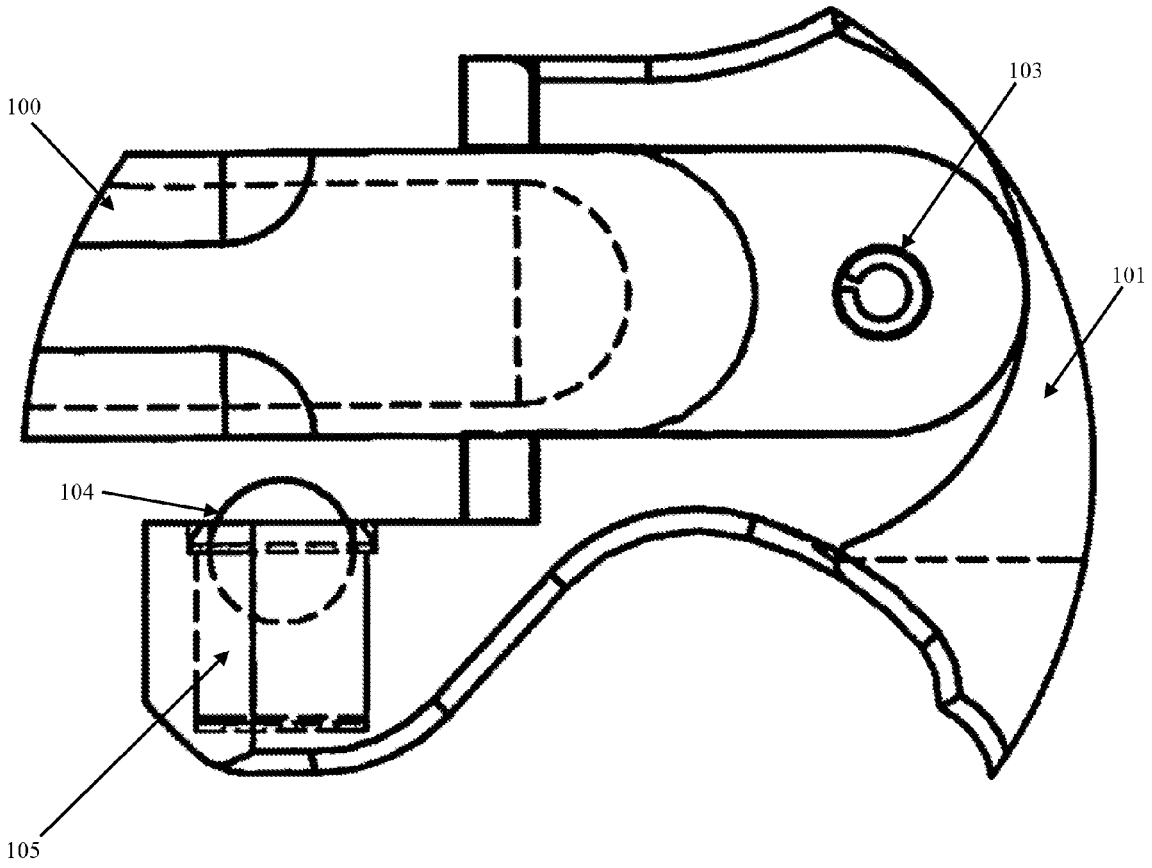
FIG. 4 is a side detail view of a detent ball assembly and roll pin in a latchless charging handle as according to one embodiment of the present invention.

The detent ball assembly (102) comprises a detent ball (FIG. 4, (104)) residing within a bored detent ball assembly cylinder (FIG. 4, (105)) that is held in place by the pressure of a spring also residing within the detent ball assembly cylinder (FIG. 4, (105)). The detent is a portion of the detent ball assembly cylinder (FIG. 4, (105)) that is of a smaller diameter than the detent ball (FIG. 4, (104)) that prevents the ball from exiting the detent ball assembly cylinder (FIG. 4, (105)) due to the pressing force of the spring. When a user actuates the latchless charging handle, the additional pressure of the user retracting the charging handle causes the detent ball (FIG. 4, (104)) to depress into the detent ball assembly cylinder (FIG. 4, (105)), compressing the spring. When the charging handle is returned, the detent ball (FIG. 4, (104)) engages with a latch pocket on the rifle's upper receiver. The latch pocket forms a recess that allows the detent ball (FIG. 4, (104)) to protrude from the detent ball assembly cylinder (FIG. 4, (105)), due to the spring pressure, and acts as the charging handle's latch mechanism. The use of a detent ball assembly (102) instead of a traditional charging handle latch provides greater clearance between the present invention and the rifle. A mounted scope system can be installed on the rifle without concerns of interfering with the action of the charging handle.

A roll pin (103) is used to connect the charging bar handle (101) to the bolt interface (100). The roll pin (103) is a mechanical fastener having a cylindrical pin passing through a hole in the charging bar handle (101) and the bolt interface (100). The pin is slotted to allow for some flexibility during insertion. It should be noted that some embodiments of the present invention may use a spring pin in place of the roll pin (103) as the mechanical fastener that connects the charging bar handle (101) to the bolt interface (100).

Figure 5:
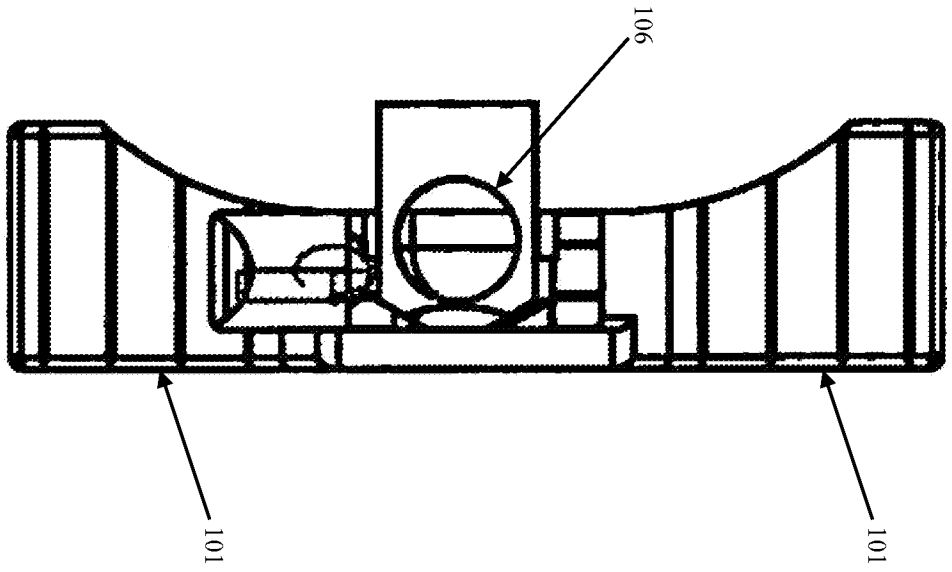
FIG. 5 is a rear cross-sectional view of an exemplary a latchless charging handle as according to one embodiment of the present invention.

A gas tube hole (FIG. 5, (106)) is bored through the bolt interface (100) that directs combusted powder gases to cause operation of a rifle's bolt or bolt assembly within the receiver. When a cartridge is fired, the gases produced by the burning powder are directed through the gas tube hole (FIG. 5, (106)) to exert a rearward force upon a rifle's bolt carrier that results in the unlocking of the bolt and movement of the bolt to a rearward, open position. The direction of the gases through the gas tube hole (FIG. 5, (106)) to the bolt is necessary to cycle the next cartridge and continue the firing operations of the rifle.

Some embodiments of the present invention contain components that are manufactured by the Computer Numerical Control (CNC) machining of metallic materials. Particularly, in some embodiments of the present invention, the bolt interface (100) and charging bar handle (101) are CNC machined from billet aluminum and are hard anodized and colored per military specification MIL-A-8625 type 3 class 2 black. In these or other embodiments of the present invention, the roll pin (103) and detent ball assembly (102) may be made of the same or different materials. Furthermore, other embodiments of the present invention may use different grades of aluminum, varying grades of steel, or other anodizing and coloring methods as required for the particular application. One skilled in the art can vary the method of manufacture and material used to form the components without undue effort or experimentation.

As set forth in this description and the attached images, a new latchless charging handle has been developed that improves upon conventional charging handles. The various embodiments of the improved latchless charging handle described herein can be used in a wide variety of applications.

The preceding exemplary embodiments are not intended to be limiting, but are merely illustrative for the possible uses of the latchless charging handle.

Although certain example apparatus and articles of manufacture have been described herein, the scope of coverage of this patent is not limited thereto. On the contrary, this patent covers all apparatus and articles of manufacture fairly falling within the scope of the invention either literally or under the doctrine of equivalents.

With respect to the above description then, it is to be realized that the optimum dimensional relationships for the components of the latchless charging handle, to include variations in size, materials, shape, form, function and the manner of operation, and use, are deemed readily apparent and obvious to one skilled in the art, and all equivalent relationships to those illustrated in the images and described in the specification are intended to be encompassed by the latchless charging handle.

Directional terms such as "front", "back", "in", "out", "downward", "upper", "lower", "top", "bottom", "lateral", "vertical" and the like have been used in the description. These terms are applicable to the embodiments shown and described in conjunction with the images. These terms are merely used for the purpose of description in connection with the images and do not necessarily apply to the positions in which the latchless charging handle may be used.

Therefore, the foregoing is considered as illustrative only of the principles of the latchless charging handle. Further, since numerous modifications and changes will readily occur to those skilled in the art, it is not desired to limit the latchless charging handle to the exact construction and operation shown and described, and accordingly, all suitable modifications and equivalents may be resorted to, falling within the scope of the latchless charging handle. While the above description describes various embodiments of the present invention, it will be clear that the present invention may be otherwise easily adapted to fit any configuration where a latchless charging handle is desired or required.

As various changes could be made in the above constructions without departing from the scope of the invention, it is intended that all matter contained in the above description or shown in the accompanying images shall be interpreted as illustrative and not in a limiting sense.

What is claimed is:

1. A charging handle comprising:

a detent ball assembly that secures the charging handle to a firearm when the charging handle is not in use; an interface for interfacing the charging handle with the bolt of a firearm, wherein the interface contains a gas tube that allows gases generated from the firing of a cartridge to cycle the bolt of the firearm; and a charging bar handle located at the rearward portion of the charging handle that is connected to the interface by way of a mechanical fastener, the charging bar handle allowing a user to retract the charging handle to charge the firearm.

2. The charging handle of claim 1, wherein the detent ball assembly comprises a detent ball residing within a detent ball assembly cylinder, the detent ball being held in place by spring pressure.

3. The charging handle of claim 2, wherein the spring pressure is provided by a spring within the detent ball assembly cylinder.

4. The charging handle of claim 1, wherein the detent ball assembly engages with a latch pocket on the firearm to secure the charging handle of the firearm when the charging handle is not in use.

5. The charging handle of claim 1, wherein the interface is generally elongated in shape with an upper surface and a lower surface.

6. The charging handle of claim 1, wherein the mechanical fastener is a roll pin or a spring pin.

7. The charging handle of claim 1, wherein the latchless firearm charging handle is designed to be used with a rifle.

8. An apparatus comprising:

a latchless charging handle for charging a firearm, the latchless charging handle having: a bolt interface that interfaces with a bolt or a bolt assembly of the firearm, the bolt interface being a generally elongated member with an upper surface, a lower surface, a forward part that interfaces with the bolt or the bolt assembly of the firearm, and a rear part that is attached to a charging bar handle, the charging bar handle having a handhold that allows users to actuate the latchless charging handle from either side of the firearm; a gas tube hole bored into the bolt interface that directs combusted powder gases to cause operation of the firearm's bolt or bolt assembly; and a detent hall assembly that holds the latchless charging handle in a fixed position relative to the firearm when the latchless charging handle is not being actuated by a user.

9. The apparatus of claim 8, wherein the latchless charging handle is designed for use with a rifle.

10. The apparatus of claim 8, wherein the bolt interface directly contacts the bolt or the bolt assembly of the firearm.

11. The apparatus of claim 8, wherein the attachment means for attaching the bolt interface to the charging bar handle is a mechanical fastener.

12. The apparatus of claim 1, wherein the mechanical fastener is a roll pin or a spring pin.

13. The apparatus of claim 8, wherein the detent ball assembly comprises a ball and spring assembly where the ball resides within a detent ball assembly cylinder and is held in place by spring pressure.

14. The apparatus of claim 13, wherein the spring is contained within the detent ball assembly cylinder.

15. A charging handle for a rifle comprising:

an elongated bolt interface with a forward part that interfaces with a bolt or a bolt assembly of the AR-15® rifle, the forward part of the bolt interface also having a gas tube hole that directs combusted powder gases to the bolt or the bolt assembly so that the bolt or the bolt assembly may cycle, the elongated bolt interface also having a rear part containing a detent ball assembly that engages with a latch pocket on the AR-15® rifle to secure the charging handle, the detent ball assembly comprising a detent ball residing within a detent ball assembly cylinder that is shaped so that the detent ball cannot exit the cylinder, the detent ball being held in place by spring pressure provided by a spring within the detent ball assembly cylinder, the detent ball compressing into the detent ball assembly cylinder when the charging handle is actuated, the rear part of the elongated bolt interface also containing a mechanical connection means for securing a charging bar handle to the charging handle, the charging bar handle comprising one or more handholds that allow users to actuate the charging handle, the charging bar handle being shaped so that it does not interfere with sights or a scope system mounted on the AR-15® rifle, and the charging handle being able to be actuated by users from either side of the AR-15® rifle.

16. The charging handle of claim 15, wherein the combusted powder gases are generated by the firing of a cartridge.

17. The charging handle of claim 15, wherein the bolt interface and the charging bar handle are formed of billet aluminum.

18. The charging handle of claim 17, wherein the bolt interface and charging bar handle are hard anodized and colored.

19. The charging handle of claim 18, wherein the coloring is black.

20. The charging handle of claim 15, wherein the mechanical connection means is a roll pin or a spring pin.

* * * * *